US006404995B1

(12) United States Patent
Kimizuka

(10) Patent No.: US 6,404,995 B1
(45) Date of Patent: Jun. 11, 2002

(54) IMAGE FORMING APPARATUS INCLUDING A UNIT DETACHABLY ATTACHABLE TO THE MAIN ASSEMBLY HAVING A MEMORY AND AN ANTENNA ELECTRICALLY CONNECTED TO THE MEMORY

(75) Inventor: Junichi Kimizuka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/286,426

(22) Filed: Apr. 6, 1999

(30) Foreign Application Priority Data

Apr. 10, 1998 (JP) ..... 10-116122

(51) Int. Cl.[7] ..... G03G 15/00
(52) U.S. Cl. ..... 399/13; 399/25; 399/111
(58) Field of Search ..... 399/111, 12–13, 399/25

(56) References Cited

U.S. PATENT DOCUMENTS 5,030,114 A * 7/1991 Carey et al. ..... 432/92
5,909,603 A * 6/1999 Suzuki et al. ..... 399/13
5,926,666 A * 7/1999 Miura et al. ..... 399/25

FOREIGN PATENT DOCUMENTS

| | | | |
|---|---|---|---|
| JP | 63-163383 | * | 7/1988 |
| JP | 1-195462 | * | 8/1989 |
| JP | 3-11300 | * | 1/1991 |
| JP | 8-160680 | | 6/1996 |
| JP | 2000-347550 | * | 12/2000 |
| JP | 2000-60042 | * | 3/2001 |
| JP | 2001-166639 | * | 6/2001 |

* cited by examiner

*Primary Examiner*—Quana M. Grainger
(74) *Attorney, Agent, or Firm*—Fitzpatrick, Cella, Harper & Scinto

(57) ABSTRACT

An image forming apparatus includes a main assembly, a unit detachably attachable to the main assembly, the unit having a memory and a first antenna electrically connected to the memory, communicator for communicating with the memory when the unit is mounted on the main assembly, the communication means having a second antenna, and an electrically conductive shield surrounding at least the first antenna and the second antenna when the unit is mounted on the main assembly.

31 Claims, 8 Drawing Sheets

IMAGE FORMING APPARATUS INCLUDING A UNIT DETACHABLY ATTACHABLE TO THE MAIN ASSEMBLY HAVING A MEMORY AND AN ANTENNA ELECTRICALLY CONNECTED TO THE MEMORY

BACKGROUND OF THE INVENTION

1. Field of the Invention

This invention relates to an image forming apparatus such as a printer, a copying apparatus or a facsimile apparatus and a unit such as a process cartridge detachably attachable to the main body of the image forming apparatus.

2. Related Background Art

In recent years, various interchangeable units having semiconductor memories attached thereto have been proposed for the purpose of improving the quality of image of copying apparatuses, printers, etc. and the accurate custody of the service life of the units. For example, in Japanese Patent Application Laid-Open No. 8-160680, it is described to attach a semiconductor memory to a process cartridge detachably attachable to an electrophotographic type printer.

The process cartridge disclosed in the above-mentioned publication comprises a photosensitive drum, a charging device, a developing device and a cleaner made into a unit easily detachably attachable to an image forming apparatus of the electrophotographic type. Also the storing means of the above-described process cartridge is a semiconductive non-volatile memory in which the cumulative rotation time of the photosensitive drum is stored to detect the service life of the photosensitive drum.

Now, in the above-described apparatus, the nonvolatile memory and the main body of the image forming apparatus have been connected by a connector.

However, the signal to the memory is weak and even a slightly bad contact of the connector causes malfunctioning.

So, it has been suggested to connect the main body of the image forming apparatus and the memory together by electromagnetic coupling means, and effect bilateral communication through the electromagnetic. coupling means mechanically in non-contact to thereby avoid bad contact of the connector.

In the electromagnetic coupling, however, electromagnetic waves may leak from the coupling portion. Also, with regard to these electromagnetic waves leaking from the apparatus, the intensity thereof must be reduced to a predetermined limit by the international standard. Further, extraneous noise may jump into the coupling portion to thereby cause malfunctioning.

SUMMARY OF THE INVENTION

The present invention has been made in view of the above-described problems and an object thereof is to provide an image forming apparatus which can suppress the outward Leakage of electromagnetic waves from the communication position between the main body of the image forming apparatus and a detachably attachable unit, and a unit detachably attachable to this apparatus.

Another object of the present invention is to provide an image forming apparatus in which the communication position can be smoothly shielded when a unit is attached to the main body of the image forming apparatus, and a unit detachably attachable to this apparatus.

Still another object of the present invention is to provide an image forming apparatus having a main assembly, a unit having a memory and a first antenna electrically connected to the memory, the unit being detachably attachable to the main assembly, communication means having a second antenna and for communicating with the memory when the unit is mounted on the main assembly, and electrically conductive shield means surrounding at least the first antenna and the second antenna when the unit is mounted on the main assembly.

Yet still another object of the present invention is to provide a unit detachably attachable to an image forming apparatus, the unit having a memory, an antenna electrically connected to the memory, and an electrically conductive member disposed between a main body of the unit and the antenna.

Further objects of the present invention will become apparent from the following detailed description taken in conjunction with the accompanying drawings.

DESCRIPTION OF THE PREFERRED EMBODIMENTS

First Embodiment

A first embodiment of the present invention will hereinafter be described with reference to FIGS. 1 to 3. An image forming apparatus to which the present invention is applicable will first be described with reference to FIG. 2.

Figure 2:
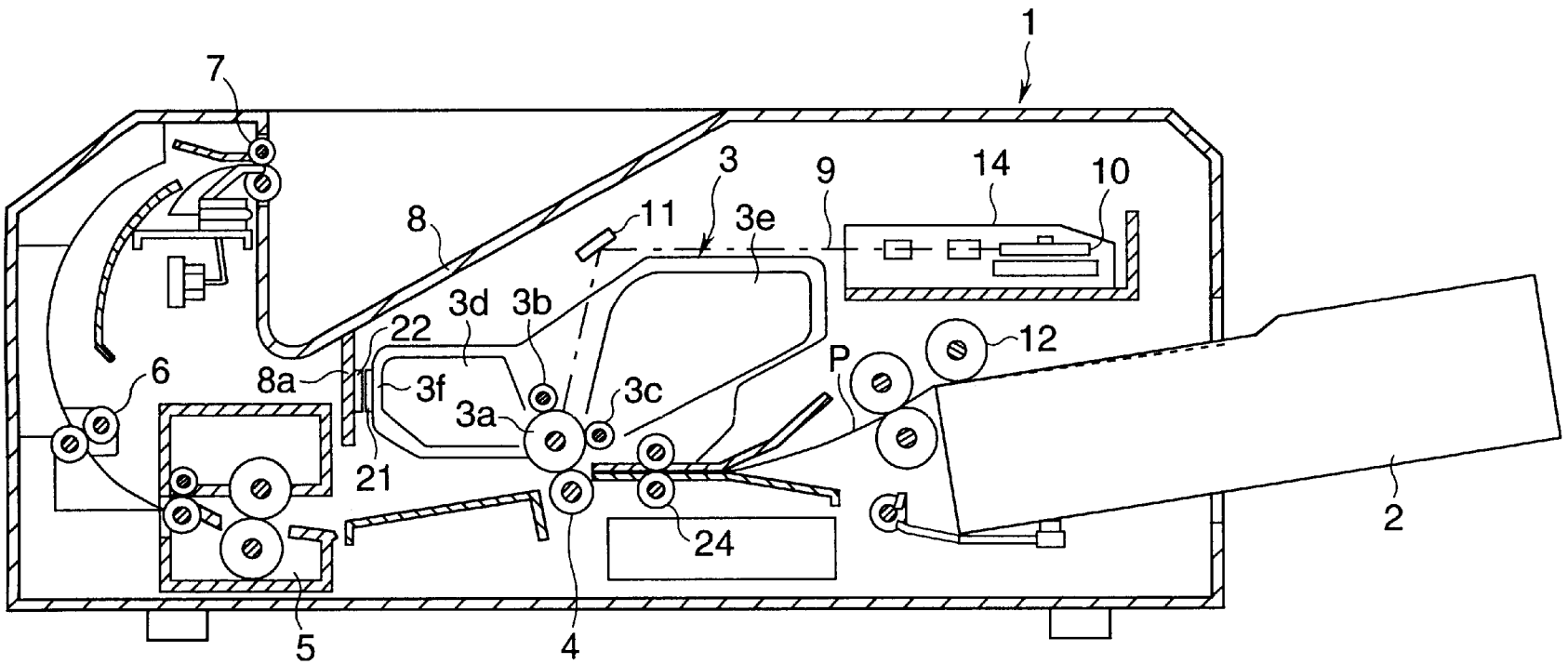
FIG. 2 schematically shows the construction of an embodiment of the image forming apparatus according to the present invention.

In FIG. 2, a process cartridge 3 is detachably attached to the image forming apparatus. The process cartridge 3, which is a detachably attachable unit, is integrally comprised of a photosensitive drum 3*a* which is an image bearing member, a charging roller 3*b* which is charging means for uniformly charging the surface of the photosensitive drum 3*a*, a developing roller 3*c* which is developing means for developing an electrostatic latent image formed on the photosensitive drum 3*a* into a toner image as a visible image, a toner hopper 3*e* for storing a toner therein, and a cleaner 3*d* as cleaning means for collecting any excess toner on the photosensitive drum 3*a*.

A semiconductive non-volatile memory unit 21 is attached to the wall surface 3*f* of the process cartridge 3. A mounting member 8*a* is supported at a location opposed to the non-volatile memory unit 21, and a main body side communication unit 22 is mounted thereon.

A laser scanner unit 14 which is image writing-in means, is provided sideways of the process cartridge 3, and scans and exposes the photosensitive drum 3*a* by a laser beam 9 modulated on the basis of an inputted image signal.

A transfer roller 4, for transferring a developed image to a recording material (sheet) P picked up from a sheet feeding cassette 2 by a sheet feeding roller 12 and timed with transfer by registration rollers 24, is disposed in opposed relationship with the underside of the photosensitive drum 3*a*.

A fixing device 5 for heating and pressing the toner image transferred to the recording material P to thereby fix the toner image is provided downstream of the transfer roller 4 with respect to the direction of conveyance of the recording material P. Sheet conveying roller 6 and sheet discharging rollers 7 for discharging the recording material P out of the apparatus are disposed downstream of the fixing device 5.

A description will hereinafter be provided of the image forming process in the image forming apparatus of the above-described construction.

The surface of the photosensitive drum 3*a* is charged by the charging roller 3*b*, and is scanned by the laser scanner unit 14 to thereby form a latent image on the surface of the photosensitive drum 3*a*. This latent image is developed by the developing roller 3*c* to thereby form a toner image.

On the other hand, the recording material P in the sheet feeding cassette 2 is picked up by the sheet feeding roller 12 and is fed to the pair of registration roller 24, and is timed and sent to a transfer position.

At this transfer position, the toner image on the photosensitive drum 3*a* is transferred to the recording material P by the action of the transfer roller 4. The recording material P, to which the toner image has been transferred, is conveyed to the fixing device 5, and is heated and pressed, whereby the toner image is fixed. Thereafter, the recording material P is discharged out of the main body 1 of the image forming apparatus by the sheet discharging rollers 7, and is stacked on a tray 8.

Figure 1:
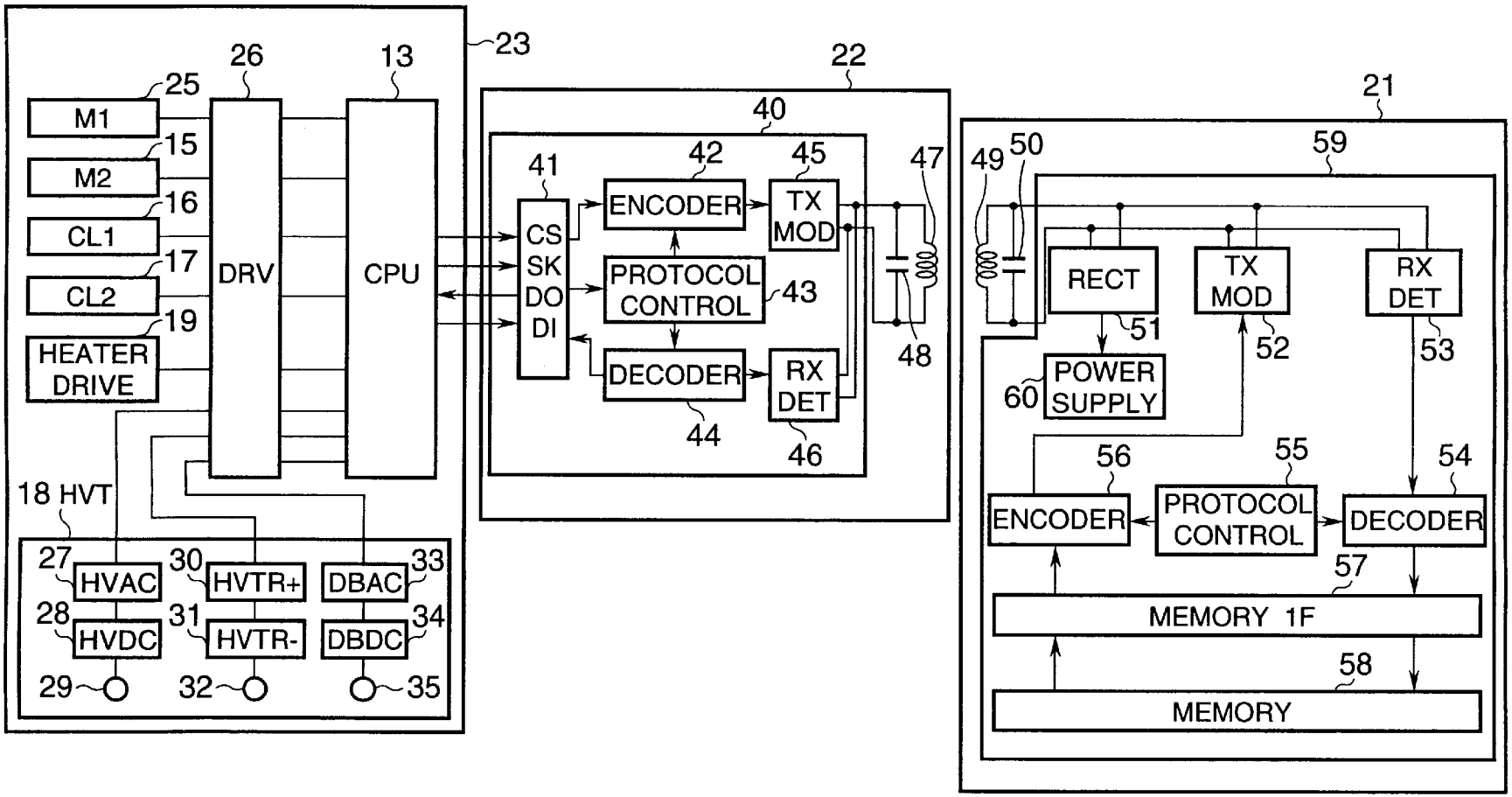
FIG. 1 is a circuit block diagram of an image forming apparatus according to an embodiment of the present invention.

FIG. 1 is a block diagram of the image forming apparatus for illustrating the first embodiment of the present invention.

In FIG. 1, an image formation control circuit 23 controls a main motor 25, a scanner motor 15, a sheet feeding clutch 16, a registration clutch 17, a high voltage unit 18, a fixing device heater driving circuit 19, etc., and effects the control for the image forming apparatus 1 to form an image.

For this purpose, the image formation control circuit 23 carries thereon a CPU 13 comprised of a one-chip microcomputer and a drive circuit 26. The drive circuit 26 is provided with the main motor 25 for driving the photosensitive drum 3*a*, the sheet feeding roller 12, the registration rollers 24, the other rollers, the fixing device 5, etc., the scanner motor 15 included in the laser scanner unit 14, the sheet feeding clutch 16 for controlling the sheet feeding roller 12, the registration clutch 17 for controlling the driving of the registration rollers 24, the high voltage unit (HVT) 18 for supplying a high voltage to the charging roller 3*b*, the developing roller 3*c* and the transfer roller 4, and the fixing device heater driving circuit 19 for driving a heater in the fixing device 5.

The high voltage unit 18 has three kinds of high voltage sources for charging, developing and transferring the photosensitive drum 3*a*.

The high voltage source for charging comprises the outputs of high voltage alternating current (HVAC) 27 and high voltage direct current (HVDC) 28 superposed one upon the other, and outputs from the output terminal 29 to the charging roller 3*b*. The high voltage source for transferring is the changeover output of high voltage DC plus (HVTR+) 30 and high voltage DC minus (HVTR−) 31, and this output is put out from a terminal 32 to the transfer roller 4. The high voltage source for developing comprises high voltage AC (DBAC) 33 and high voltage DC (DBDC) 34 superposed one upon the other, and the output thereof is put out from a terminal 35 to the developing roller 3C.

The non-volatile memory 21 attached to the process cartridge stores the time of use of the photosensitive drum 3*a* therein, and is used for the judgement of the service life of the photosensitive drum 3*a*.

The communication unit 22 has a coil or the like attached to an IC for effecting communication with the memory unit 21.

The main body side communication unit 22 will now be described in greater detail.

The communication unit 22 is provided with an IC 40 including a modulation and demodulation circuit for effecting communication, and the IC 40 includes a serial signal interface portion 41 with the CPU 13, and the interface portion 41 is provided with a CS terminal which is the input terminal of a chip select signal, an SK terminal which is the input terminal, of a serial clock, a DO terminal which is the output terminal, of the serial signal, and a DI terminal, which is a terminal for the inputting of the serial signal.

The serial signal puts the address designation of the memory, the designation of reading and writing, the data stored in the memory and the data read out of the memory onto the same signal line in a time series.

The communication unit 22 is further provided with an encoder 42, a protocol controller 43, a decoder 44, a modulator 45 for transmission, and a demodulator 46 for reception.

The serial signal from the CPU 13 is converted into a protocol suited for communication by the protocol controller 43 and is loaded into the encoder 42, and is outputted as a high frequency signal from the modulator 45 for transmission. The received data is demodulated from the high frequency signal to a base band signal by the demodulator 46, and is decoded into a serial signal fit for the CPU 13 by the decoder 44, and is sent from the interface portion 41 to the CPU 13.

The communication unit 22 is provided with a tank circuit comprising a coil 47 which is a second antenna for transmitting and receiving the high frequency signal as an electromagnetic wave and a capacitor 48.

Figure 3:
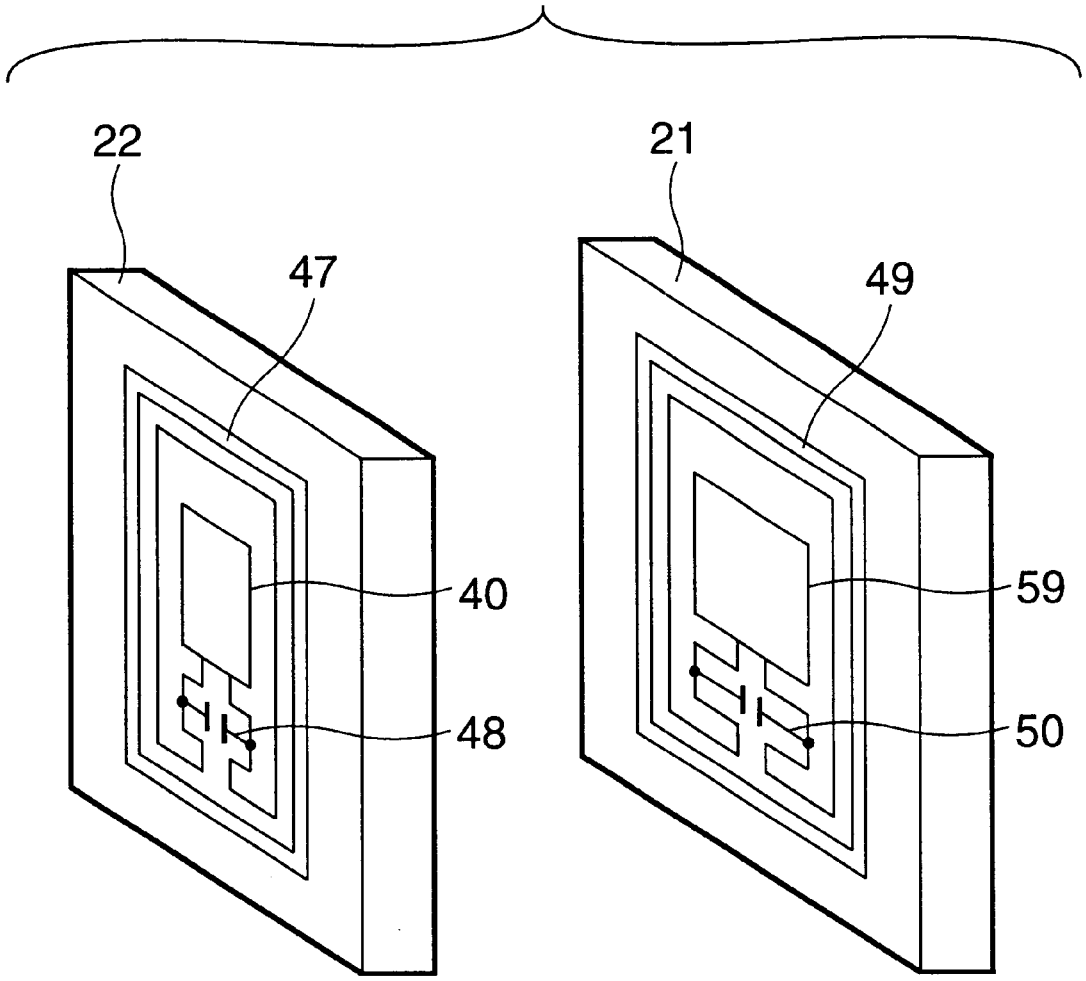
FIG. 3 is a perspective view showing an embodiment of a communication unit and a memory unit according to the present invention.

The communication unit 22 is hermetically sealed in a flat mold case, as shown in FIG. 3.

The circuit on the memory side will now be again described with reference to FIG. 1.

The memory unit 21 is provided with a tank circuit comprised of a coil 49 which is a first antenna for transmitting and receiving the high frequency signal and a capacitor 50.

A rectifying circuit 51, a transmission modulating circuit 52 and a demodulator 53 are connected to the tank circuit. The output of the rectifying circuit 51 is connected to a power source circuit 60 and supplies a power source to a memory IC 58. The memory unit 21 is further comprised of a decoder 54, a protocol controller 55, an encoder 56, a memory interface circuit 57 and a non-volatile memory 58 such as EEPROM or a ferroelectric material memory.

After the high frequency signal is demodulated into a base band signal by the demodulator 53, it is converted into a signal suited to be sent to the memory 58 by the decoder 54 in accordance with the control of the protocol controller 55.

It is then divided into an address and data by the memory interface circuit 57 and the reading-out and writing-in operations are executed by the memory 58 in accordance with a command for reading and writing.

The data read out of the memory 58 is sent from the memory interface 57 to the encoder 56 and is converted into a protocol suited for communication, and is sent from the transmission modulator 52 to the tank circuit.

This memory unit 21, as shown in FIG. 3, is comprised of an IC 59 comprising a modulator-demodulator and a memory made integral with each other, the coil 49 and the capacitor 50 which are hermetically sealed in a flat mold case.

The shield construction of the electromagnetic coupling portion will now be described with reference to FIGS. 4 to 6.

Figure 4:
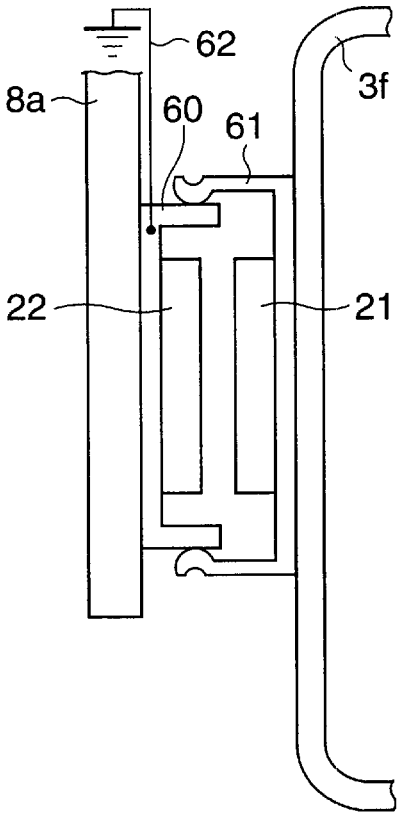
FIG. 4 is a cross-sectional view showing the construction of a shield in a first embodiment.

As shown in FIG. 4, the communication unit 22 and the memory unit 21 are disposed so as to be surrounded by shield members 60 and 61, respectively.

Figure 5:
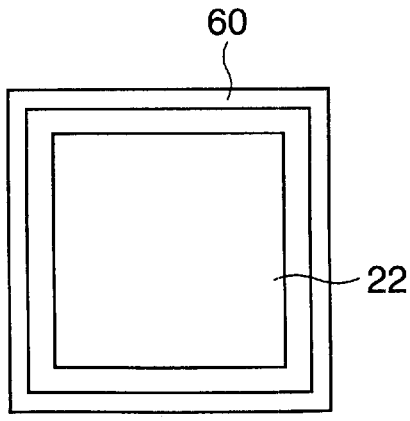
FIG. 5 is a view of a communication unit and a shield member in FIG. 4 as they are seen from the memory unit side.

The main body side shield member (second shield member) 60 is formed by a metal plate of good electrical conductivity, and is fixed to the wall surface of a mounting member 8a provided in the housing of the main body, as shown in FIG. 4 and FIG. 5 which is a view of the shield member 60 as it is seen from the cartridge 3 side, and the upper, lower, left and right end portions of the shield member 60 are bent toward the memory 21 side, and the shield member 60 is constructed so as to become somewhat higher than the thickness of the communication unit 22.

Further, the shield member 60 is grounded to a housing frame by a wire material. This ground includes a case where the shield member 60 is connected to the housing and a case where the shield member 60 is connected to the signal gland of the image formation control circuit 23. Which is better may preferably be determined by confirming the actual shielding effect.

The image formation control circuit 23 to the communication unit 22 are connected together by a bundle wire, but a shield wire having its outer side shielded by this bundle wire can also be used. In that case, the braided portion of the shield wire may be used as the ground.

Figure 6:
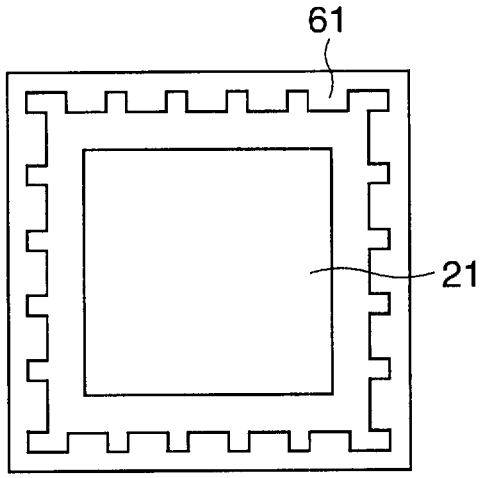
FIG. 6 is a view of the memory unit and the shield member in FIG. 4 as they are seen from the communication unit side.

On the other hand, the memory unit 21 on the cartridge 3 side, as shown in FIGS. 4 and 6, is surrounded by a shield member (first shield member) 61 which is fixed to the wall surface 3*f* of the cartridge 3.

The shield member 61 on the cartridge side is formed by a metal plate of good electrical conductivity having springiness, and the upper, lower, left and right end portions thereof are bent toward the communication unit 22 side. Each end portion is formed with slits in a strip-like shape to relax the distortion of the spring and therefore, each strip-like portion can contact the outer peripheral surface of each end portion of the main body side shield member 60 in a fitted state independently to a certain degree.

In the above-described construction, when the process cartridge 3 is to be mounted on the main body, the memory unit 21 is pressed toward the main body side, i.e., the communication unit 22 side, and the shield member 61 on the memory unit 21 side is fitted so as to cover the shield member 61 on the communication unit 22 side.

In such a manner, the cartridge 3 can be mounted on the main body of the apparatus without the shield members becoming any obstacle, and when the cartridge 3 is mounted on the main body of the apparatus, the communication unit 22 and the memory unit 21 are surrounded by the shield members 60 and 61, respectively, and the shield potential thereof is connected to the ground, whereby the communication unit and the memory unit are stably shielded at zero potential.

Electromagnetic waves leaking from the communication unit 22 and the memory unit 21 are confined in the shield members 60 and 61. Also, extraneous noise is reflected by the shield members 60 and 61 and does not enter the interiors of the shield members.

Second Embodiment

A second embodiment of the present invention will now be described with reference to FIGS. 7 to 9.

Figure 7:
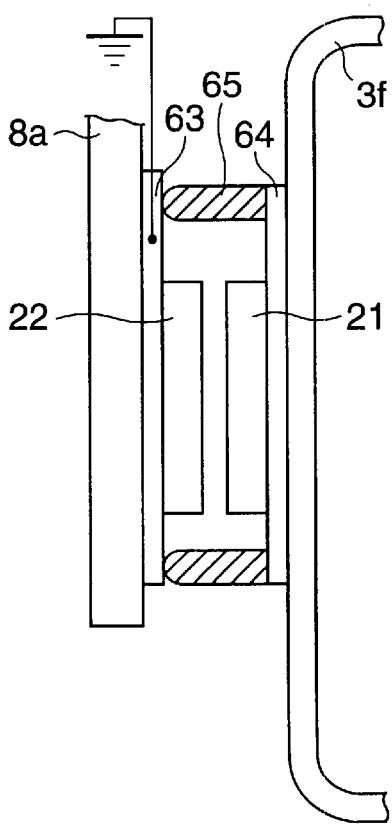
FIG. 7 is a cross-sectional view showing the construction of a shield in a second embodiment.

As shown in FIG. 7, the communication unit 22 and the memory unit 21 are disposed so as to be surrounded by shield members 63, 64 and 65.

Figure 8:
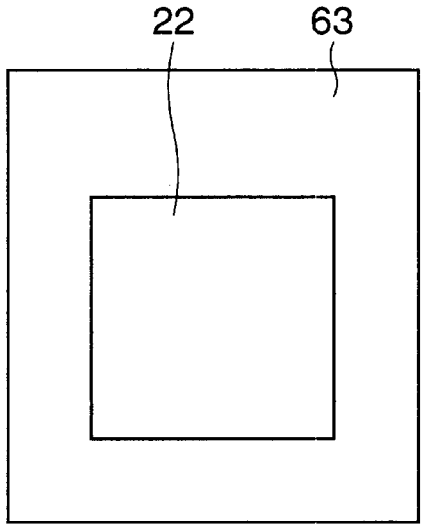
FIG. 8 is a view of a communication unit and a shield member in FIG. 7 as they are seen from the memory unit side.

The communication unit 22, as shown in FIGS. 7 and 8, is attached to substantially the center of the shield member (second shield member) 63 formed by a metal plate fixed to the wall surface Ba of the main body. The shield member 63 has good electrical conductivity and is grounded.

Figure 9:
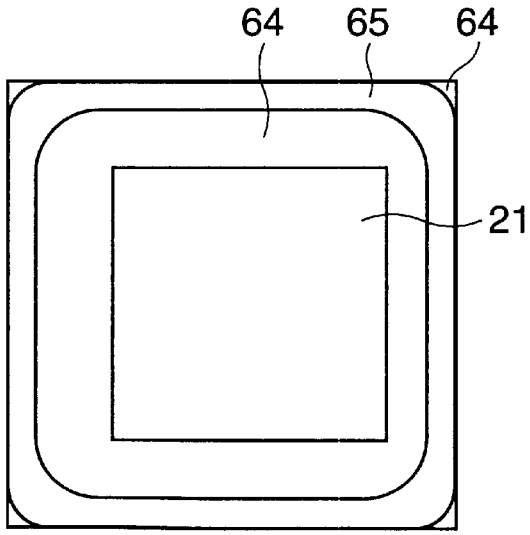
FIG. 9 is a view of the memory unit and the shield member in FIG. 7 as they are seen from the communication unit side.

On the other hand, the memory unit 21, as shown in FIGS. 7 and 9, is attached to substantially the center of the shield member 64 formed by an electrically conductive metal plate fixed to the wall surface 3*f* of the cartridge, and a gasket 65, which is a shield member, is fixed to the outer peripheral portion of the shield member 64 so as to surround the memory unit 21 and to protrude from the communication unit 22 side. The gasket 65 is of a soft and flexible construction comprising an electrically conductive mesh wound on a band of sponge. These two members 64 and 65 together constitute a first shield member.

Also, the gasket 65 is mounted at a location corresponding to the outer peripheral portion of the shield member 63 on the communication unit 22 side when the memory unit 21 and the communication unit 22 are opposed to each other.

Further, the height of the gasket 65 is set so that when the cartridge 3 is mounted on the main body of the apparatus, the tip ends of the gasket 65 may softly contact the surface of the shield member 63 on the communication unit 22 side and a predetermined spacing may be formed between the communication unit 22 and the memory unit 21.

By the shield construction as described above, the shield environment made shield environment by the shield members 63, 64 and the gasket 65 is formed around the communication unit 22 and the memory unit 21. Particularly the gasket 65 is formed of a flexible material, whereby it contacts the metal plate 63 without any gap and it never happens that an electromagnetic wave leaks. Of course, it neither happens that any noise from the outside enters the above-described shield environment.

Third Embodiment

Figure 10:
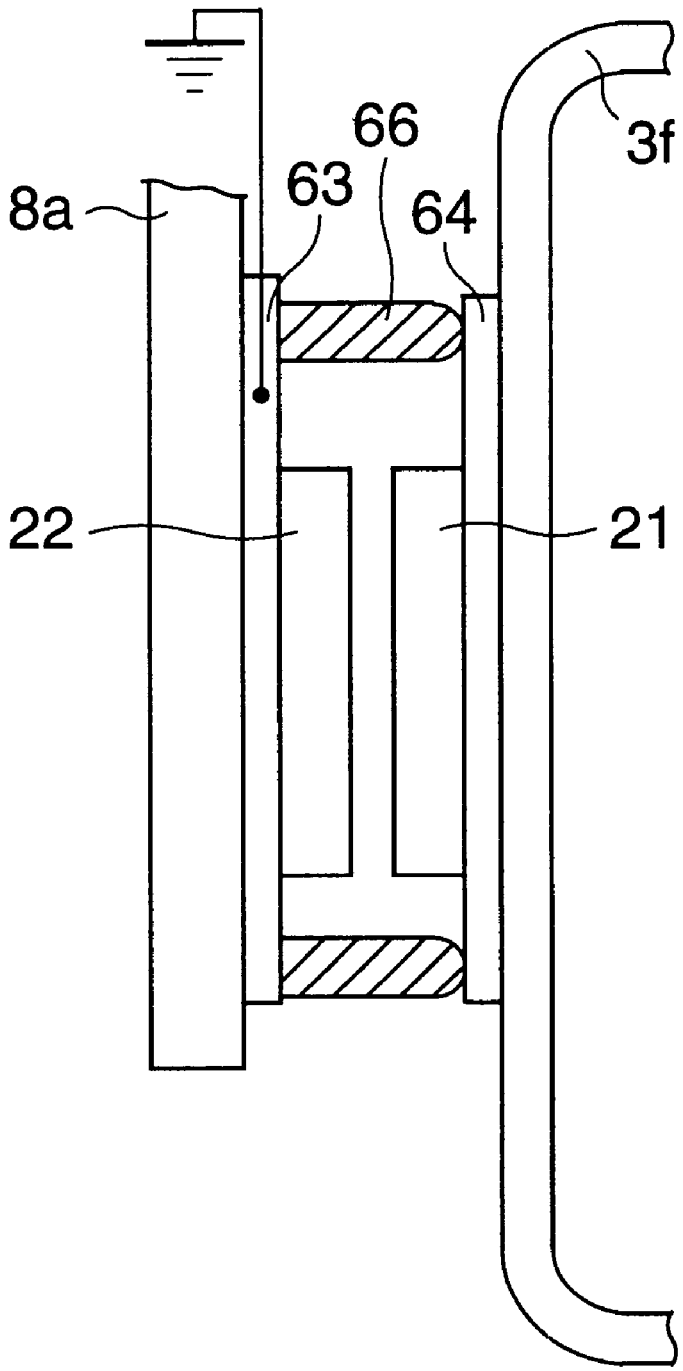
FIG. 10 is an illustration showing the construction of a shield in a third embodiment.

A third embodiment of the present invention will now be described with reference to FIG. 10.

This embodiment is substantially similar in construction to the second embodiment, but a gasket 66 is fixed to a shield member 63 on the communication unit 22 side which comprises a metal plate, and the shield member 63 and the gasket 66 together constitute a second shield member, which is brought into contact with a shield member (first shield member) 64 on the cartridge 3 side which comprises a metal plate.

As described above, the gasket 66 is provided on the communication unit 22 side, i.e., the main body side of the apparatus, whereby it never happens that as in the second embodiment, the gasket 66 is also interchanged together during the interchange of the cartridge for a predetermined number of sheets, and the number of parts used as consumption parts can be curtailed, and this can contribute to the saving of resources.

Of course, the shielding effect in the present embodiment does not differ from that in the second embodiment.

Fourth Embodiment

Figure 11:
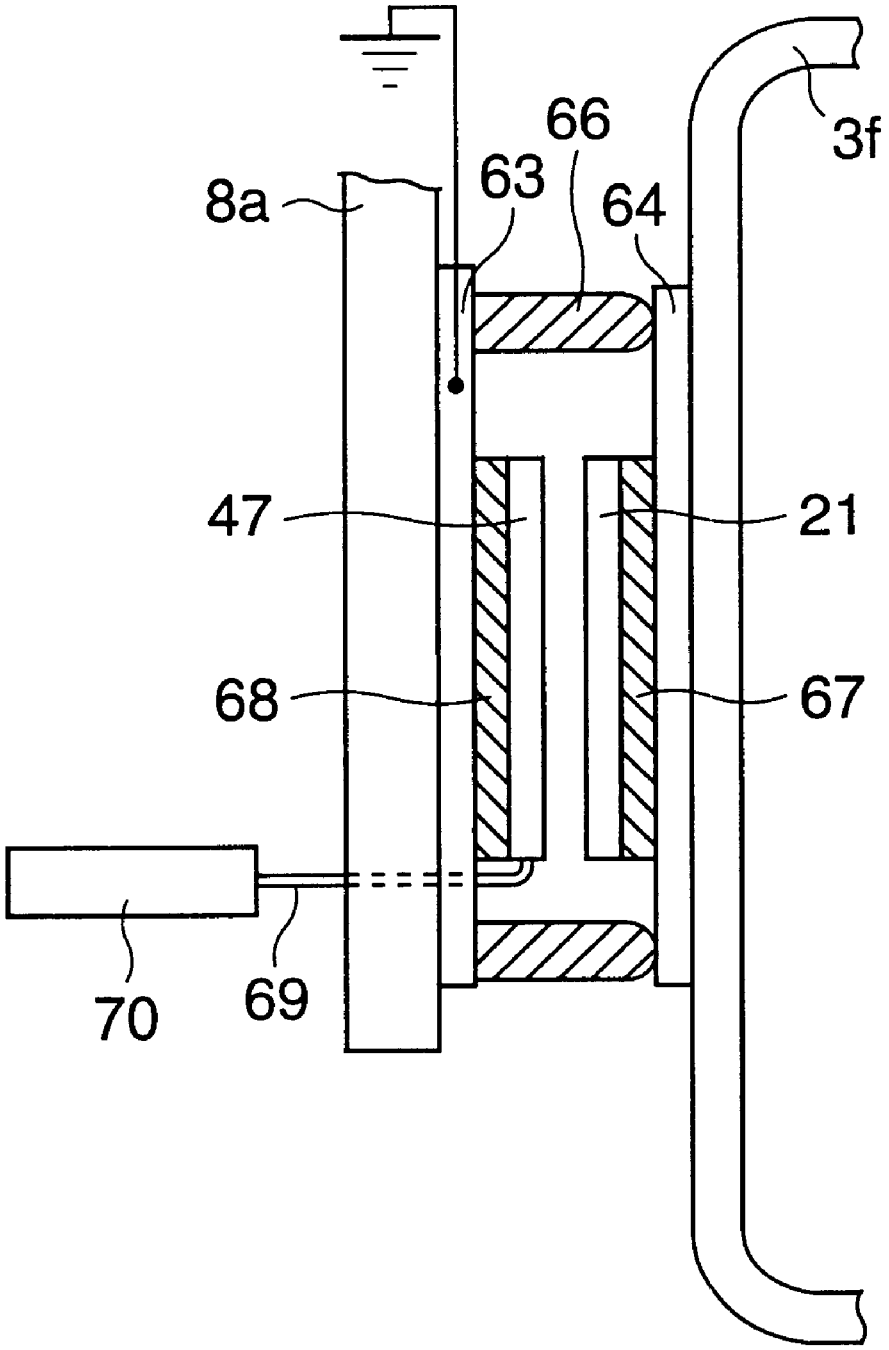
FIG. 11 shows the construction of a shield in a fourth embodiment.

FIG. 11 is a cross-sectional view showing a fourth embodiment of the present invention.

As shown in FIG. 11, in a state in which the process cartridge is mounted on the main body of the apparatus, the coil 49 (first antenna) in the memory unit 21 and the main body side coil 47 (second antenna) are opposed to each other, and when communication is effected, the coils are electromagnetically coupled together. Each of the coils 47 and 49 is a kind of loop antenna.

As in FIG. 1, capacitors 48 and 50 are connected to the coils 47 and 49, respectively, and the coils and the capacitors together constitute a resonance circuit.

When the shield member is too proximate to these coils, the electrostatic capacity between the coils and the shield member increases, whereby the resonance frequency may be varied or an eddy current may be created in the shield member by a magnetic field produced from the coils. By these phenomena, a reduction in the communication efficiency of the electromagnetically coupled portion may occur.

The proper distance between the shield member and the coil differs depending on the kind of the shield member and the frequency used, and actually is of the order of several millimeters to ten and several millimeters.

So, in the present embodiment, as shown in FIG. 7, insulating members 67 and 68 are disposed between the antenna and the shield member so that the antenna may not be in close contact with the shield member. Also, as shown in FIG. 7, the communication unit except the antenna 47 is brought out of the enclosure of shield means 63, 64 and 66 and is contained in a case 70. Accordingly, lines 69 extending from the opposite end portions of the coil 47 are connected to the interior of the case 70.

A modulation and demodulation IC 40 and a capacitor 48 are contained in the case 70, and the case 70 itself also is a shield member. Lead wires are used as the lines 69, whereby the lines 69 are effective to suppress the emission of an electromagnetic wave.

In the present embodiment, the insulating members are disposed between the antenna coils and the shield members, whereby the antenna coils 47 and 49 can be floated from the shield members and thus, the reduction in the communication transmission efficiency by the influence of the shield members can be suppressed.

Also, the antenna coil 47 is separated from the communication unit 22, whereby the portion 47 of FIG. 7 can be made thin, and the cartridge can be disposed in proximity to the main body side.

The present invention is not restricted to the above-described embodiments, but covers modifications of the same technical idea.

What is claimed is:

1. An image forming apparatus comprising:

a main assembly;

a unit detachably attachable to said main assembly, said unit having a memory and a first antenna electrically connected to said memory;

communication means for communicating with said memory when said unit is mounted on said main assembly, said communication means having a second antenna facing said first antenna when said unit is mounted on said main assembly; and an electrically conductive shield surrounding at least said first antenna, said memory, and said second antenna when said unit is mounted on said main assembly, said electrically conductive shield being electrically grounded.

2. An image forming apparatus according to claim 1, wherein said memory and said first antenna are mounted on a common member, and said shield means surrounds the member on which said memory and said first antenna are mounted and said second antenna.

3. An image forming apparatus according to claim 2, wherein said communication means has an IC for communicating with said memory, said IC and said second antenna are mounted on a common member, and said shield means surrounds the member on which said memory and said first antenna are mounted and the member on which said IC and said second antenna are mounted.

4. An image forming apparatus according to claim 1, wherein said shield means has an electrically conductive first shield member attached to said unit, and an electrically conductive second shield member attached to said main assembly, and said first shield member and said second shield member cooperate with each other to surround said first antenna and said second antenna when said unit is mounted on said main assembly.

5. An image forming apparatus according to claim 4, wherein at least one of said first shield member and said second shield member has elasticity.

6. An image forming apparatus according to claim 4, wherein said first shield member is disposed between a main body of said unit and said first antenna.

7. An image forming apparatus according to claim 4, wherein said second shield member is disposed between said main assembly and said second antenna.

8. An image forming apparatus according to claim 6, further comprising an insulating member between said first shield member and said first antenna.

9. An image forming apparatus according to claim 7, further comprising an insulating member between said second shield member and said second antenna.

10. An image forming apparatus according to claim 1, further comprising an image bearing member, charging means for charging said image bearing member, image writing-in means for forming a latent image on said image bearing member, developing means for developing the latent image formed on said image bearing member, transferring means for transferring an image from said image bearing member to a recording material, and cleaning means for cleaning said image bearing member.

11. An image forming apparatus according to claim 10, wherein said unit is a process cartridge having at least one of said image bearing member, said charging means, said developing means and said cleaning means.

12. An image forming apparatus according to claim 11, wherein said image bearing member is an electrophotographic photosensitive member.

13. A unit detachably attachable to an image forming apparatus, said unit comprising:

a memory;

an antenna electrically connected to said memory; and an electrically conductive member disposed between a main body of said unit and said antenna.

14. A unit according to claim 13, wherein said memory and said antenna are mounted on a common member.

15. A unit according to claim 13, further comprising at least one of an image bearing member, charging means for charging said image bearing member, developing means for developing a latent image formed on said image bearing member, and cleaning means for cleaning said image bearing member.

16. A unit according to claim 15, wherein said image bearing member is an electrophotographic photosensitive member.

17. A unit detachably attachable to an image forming apparatus, said unit comprising:

a memory;

an antenna electrically connected to said memory; and an electrically conductive member disposed between a main body of said unit and said antenna, wherein said electrically conductive member is of a hollow shape, and said antenna is disposed in a bottom of a depression thereof.

18. A unit according to claim 14, wherein a tip end of said electrically conductive member has elasticity.

19. A unit according to claim 17, wherein said memory and said antenna are mounted on a common member.

20. A unit according to claim 17, further comprising at least one of an image bearing member, charging means for charging said image bearing member, developing means for developing a latent image formed on said image bearing member, and cleaning means for cleaning said image bearing member.

21. A unit according to claim 20, wherein said image bearing member is an electrophotographic photosensitive member.

22. A unit detachably attachable to an image forming apparatus, said unit comprising:

a memory;

an antenna electrically connected to said memory; and an electrically conductive member disposed between a main body of said unit and said antenna, further comprising an insulating member between said antenna and said electrically conductive member.

23. A unit according to claim 22, wherein said memory and said antenna are mounted on a common member.

24. A unit according to claim 22, further comprising at least one of an image bearing member, charging means for charging said image bearing member, developing means for developing a latent image formed on said image bearing member, and cleaning means for cleaning said image bearing member.

25. A unit according to claim 24, wherein said image bearing member is an electrophotographic photosensitive member.

26. A unit detachably attachable to an image forming apparatus, said unit comprising:

a memory;

a first antenna electrically connected to said memory, and electromagnetically coupled with a second antenna of said image forming apparatus when said unit is mounted on said image forming apparatus; and a first electrically conductive shield member surrounding at least said first antenna, said memory, and said second antenna when said unit is mounted on said image forming apparatus.

27. A unit according to claim 26, wherein said memory and said first antenna are mounted on a common member, and wherein said first electrically conductive shield member surrounds the member on which said memory and said first antenna are mounted and second antenna.

28. A unit according to claim 26, wherein said image forming apparatus including a second electrically conductive shield member, and wherein said first shield member and said second shield member cooperate with each other to surround said first antenna, said memory, and said second antenna when said unit is mounted on said image forming apparatus.

29. A unit according to claim 28, wherein at least one of said first shield member and second shield member has elasticity.

30. A unit according to claim 28, wherein said first shield member is disposed between a main body of said unit and said first antenna.

31. A unit according to claim 30, further comprising an insulating member between said first shield member and said first antenna.

* * * * *

UNITED STATES PATENT AND TRADEMARK OFFICE

CERTIFICATE OF CORRECTION

PATENT NO. : 6,404,995 B1 
DATED : June 11, 2002
INVENTOR(S) : Junichi Kimizuka

It is certified that error appears in the above-identified patent and that said Letters Patent is hereby corrected as shown below:

Title page,
Item [56], References Cited, FOREIGN PATENT DOCUMENTS, "2000-60042 3/2001" should read -- 2001-60042 3/2001 --.
Item [57], ABSTRACT,
Line 6, "communication means" should read -- communicator --.

Column 1,
Line 18, "accurate custody" should read -- accurate recording --.
Line 41, "electromagnetic." should read -- electromagnetic --.
Line 56, "Leakage" should read -- leakage --.

Column 3,
Line 9, "unit 14" should read -- unit 14, --.

Column 4,
Line 30, "SK terminal" should read -- SK terminal, --.
Line 31, "terminal," should read -- terminal --.
Line 31, "DO terminal" should read -- DO terminal, --.
Line 32, "terminal," (first occurrence) should read -- terminal --.

Column 6,
Line 23, "Ba" should read -- 8a --.
Line 47, "shield environment" should be deleted.

Column 9,
Line 19, "claim 14," should read -- claim 17, --.

UNITED STATES PATENT AND TRADEMARK OFFICE

CERTIFICATE OF CORRECTION

PATENT NO. : 6,404,995 B1
DATED : June 11, 2002
INVENTOR(S) : Junichi Kimizuka

It is certified that error appears in the above-identified patent and that said Letters Patent is hereby corrected as shown below:

Column 10,
Line 26, "including" should read -- includes --.

Signed and Sealed this

Thirteenth Day of May, 2003

JAMES E. ROGAN
*Director of the United States Patent and Trademark Office*